US012606884B2

(12) United States Patent
Brewer

(10) Patent No.: US 12,606,884 B2
(45) Date of Patent: Apr. 21, 2026

(54) PROCESS AND METHOD FOR SEPARATING RARE EARTH ELEMENTS FROM LEACH SOLUTIONS

(71) Applicant: RARE EARTH SALTS SEPARATION AND REFINING, LLC, Minot, ND (US)

(72) Inventor: Joseph Brewer, Beatrice, NE (US)

(73) Assignee: RARE EARTH SALTS SEPARATION AND REFINING, LLC, Minot, ND (US)

( * ) Notice: Subject to any disclaimer, the term of this patent is extended or adjusted under 35 U.S.C. 154(b) by 391 days.

(21) Appl. No.: 18/193,860

(22) Filed: Mar. 31, 2023

(65) Prior Publication Data

US 2023/0313335 A1 Oct. 5, 2023

Related U.S. Application Data

(60) Provisional application No. 63/327,477, filed on Apr. 5, 2022.

(51) Int. Cl.
*C22B 3/06* (2006.01)
*C22B 59/00* (2006.01)

(52) U.S. Cl.
CPC ..... *C22B 3/06* (2013.01); *C22B 59/00* (2013.01)

(58) Field of Classification Search
None
See application file for complete search history.

(56) References Cited

U.S. PATENT DOCUMENTS 5,338,520 A 8/1994 Leveque et al.

FOREIGN PATENT DOCUMENTS

CN 112981148 A 6/2021
WO 2021176037 A1 9/2021

OTHER PUBLICATIONS

Bauer, et al. "Recovery of cerium and lanthanum by ozonation of lanthanide solutions" U.S. Dept. of the Interior, Bureau of Mines S. Bureau of Mines. Report of investigations 7123. May 1968; entire document, in particular pp. 2, 5-7, tables 2-3, figure 2.
International Application PCT/US2023/17050 International Search Report and Written Opinion mailed Dec. 14, 23023, 9 pages.

*Primary Examiner* — Anthony M Liang
(74) *Attorney, Agent, or Firm* — Milligan PC LLO

(57) ABSTRACT

An improved method for separating individual and/or groups of rare earth elements from rare earth bearing leach solutions to produce high purity materials for further refinement. According to a first preferred embodiment, the present invention includes a method comprising the steps of: neutralizing a leach solution; introducing ozone into the solution while controlling pH and precipitating cerium oxide; removing the precipitated cerium oxide from the solution; adjusting the pH of the solution in the presence of ozone to precipitate medium/heavy rare earths; removing the precipitated rare earth concentrate from the solution; treating the remaining solution with a precipitating agent to produce a high purity lanthanum precipitate; and removing the solids from the solution.

11 Claims, 2 Drawing Sheets

PROCESS AND METHOD FOR SEPARATING RARE EARTH ELEMENTS FROM LEACH SOLUTIONS

RELATED APPLICATIONS

The present application claims priority to U.S. Provisional Application No. 63/327,477 filed Apr. 5, 2022.

BACKGROUND AND FIELD OF THE PRESENT INVENTION

Field of the Present Invention

The present invention relates to separation of rare earth elements (REE). More specifically, the present invention relates to a method for separating rare earth elements out of rare earth deposits containing rare earth elements, leach solutions and concentrates.

Background of the Invention

Rare earth elements principally include the lanthanide series of the Periodic Table, but the term can also incorporate scandium and yttrium. Exemplary rare earth elements, include: lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (ET), thulium (Tm), ytterbium (Mb), lutetium (Lu), scandium (Sc) and yttrium (Y). The rare earth elements can be broken down into light, medium and/or heavy rare earth elements. Exemplary light rare earth elements include La, Ce, PC, and Nd. Exemplary medium rare earth elements include Sm, Eu, and Gd also known as SEG. Exemplary heavy rare earth elements include Sc, Tb, Dy, Ho, Er, Tm, Yb, Lu. and Y.

Many of the known rare earth mineral resources globally are made up of light rare earth elements at percentages ranging between 90-95% by weight of the total rare earths and medium rare earths at around 5% of the total rare earths. Many deposits contain the heavy rare earths at values of less than 1% by total rare earth content.

The related art discloses a number of different methods and apparatuses for the extraction of rare earth elements. Some of the currently utilized methods can be very complex because they require a large number of steps to separate the raw materials into the individual elements of high purity. This results in processes that are very capital intensive and difficult to deploy. Other methods have proven to be very difficult to scale up to industrial levels. It would be possible to deploy a number of these methods more readily if the overall process complexity or volume of material to be processed could be substantially reduced.

Bauer et al. in "*Recovery Of Cerium And Lanthanum By Ozonation Of Lanthanide Solutions*" discloses a process including oxidation of mixed lanthanide solutions with ozone at pH 45 and at ambient temperature to precipitate 98 percent of the original cerium present. Corresponding cerium purity was increased from 50 to 98 percent. A second ozone oxidation-precipitation step produced cerium of 99.9 percent purity in high yield from the 98-percent-pure material Alternately, ozonation at pH 6.5 and 850 C differentially precipitated cerium and rare-earth elements heavier than cerium and left 89 percent of the original lanthanum in solution at a purity of 95 percent. Subsequent recovery of cerium from the heavier rare-earth elements in the precipitate was accomplished by dissolving the precipitate in dilute mineral acid and reoxidizing the cerium with ozone at pH 4.5 and at ambient temperature. The filtrate contained an enriched praseodymium-neodymium-samarium-europium mixture that is amenable to separation by ion exchange or solvent extraction.

WO2016/058007 discloses a method for the selective separation of rare earth elements, which includes the steps of: digesting a rare earth oxide powder in nitric acid to form a first rare earth solution including solubilized rare earth elements; contacting the first rare earth solution with ammonium hydroxide to precipitate a first precipitation product and form a second rare earth solution; separating the first precipitation product from the second rare earth solution; increasing the pH of the second rare earth solution to precipitate additional rare earth elements from the second rare earth solution as a first intermediate particulate feed; digesting the first intermediate particulate feed in nitric acid to form a third rare earth solution; and contacting the third rare earth solution with ammonium hydroxide to precipitate a second precipitation product and form a fourth rare earth solution.

WO2016/011540 discloses treatment of a REE water leachate by a series of purification and precipitation steps to produce a high purity mixed rare earth oxide for refining using solvent extraction technology. An exemplary process of purification uses pH adjustment steps, for example with MgO, $MgCO_3$ or $Na_2CO_3$ to remove thorium and iron from solution, along with other minor impurity elements. In alternative embodiments, uranium may be removed from the water leach solution by ion exchange. The purified solution may then be treated with soda ash to precipitate an impure rare earth carbonate. The rare earth carbonate may then be dissolved in hydrochloric acid (or another acid) and the pH adjusted again to precipitate small amounts of remaining iron and thorium. The purified hydrochloric acid leach solution may then be treated with oxalic acid to precipitate all the rare earths as a mixed rare earth oxalate product. In alternative embodiments, a two-stage precipitation is provided from the chloride releach solution. Two stage precipitation may be carried out so as to facilitate the recovery of: (a) a high purity initial precipitate containing for example at least 90% of the rare earths and (b) a lower purity second precipitate for recycling. The second precipitate may for example be a carbonate precipitate, which may be returned directly to the releach process with a mineral acid.

WO2016/025928 discloses a method for extracting and separating rare earth elements including: providing a rare earth-containing ore or tailings; grinding the rare earth-containing ore to form powdered ore; leaching powered ore with at least one mineral acid; forming a leach solution including at least one metal ion, rare earth elements and a solid material; separating solid material from the leach solution to form aqueous-metal concentrate; precipitating the aqueous-metal concentrate to selectively remove the metal ion from the leach solution and obtain a precipitate of rare earth elements; heating the precipitate of rare earth elements in air to form oxide of rare earth elements; mixing the oxide of rare earth elements with an ammonium salt and heating in a dry air/nitrogen; forming a mixture of anhydrous rare earth salts in an aqueous solution, and separating rare earth elements from the aqueous solution by means of an electrowinning process.

Though useful in some situations, the methods of the prior art are cumbersome and require many steps and reagents. Accordingly, an improved method for separating rare earth elements from leach solutions is needed.

SUMMARY AND OBJECTS OF THE INVENTION

Based on the foregoing, it should be apparent that there is a strong need for an improved method for a simple, easily scaled, low-cost process for separating individual and/or groups of rare earth elements from rare earth bearing leach solutions to produce high purity materials that can be more easily refined. Additionally, there is a need for a method specifically adapted to the separation of light rare earth elements from the medium and heavy rare earth elements to increase the production of rare earths globally.

In a first aspect, the present invention relates to a method for separating rare earth elements including the steps of:

a. neutralizing a leach solution (i) including at least two rare earth metal salts and (ii) having a pH of preferably between 2 and 6;
b. introducing ozone into the solution while controlling pH between 2 and 6 and precipitating cerium oxide having a purity of greater than 97% from the solution;
c. removing the precipitated cerium oxide from the solution;
d. adjusting the pH of the solution to between 6.0 and 8.0 in the presence of ozone to precipitate medium/heavy rare earths, Nd and Pr oxyhydroxides/hydroxides;
e. removing the precipitated rare earth concentrate from the solution;
f. treating the remaining solution with a precipitating agent to produce a high purity lanthanum precipitate; and
g. removing the solids from the solution.

In a second aspect, the present invention relates to a method for separating cerium from a leach solution including at least two rare earth metal salts and having a pH of less than 3. According to a preferred embodiment, this method may preferably include the steps of:

a. treating the solution with anhydrous ammonia to raise the pH to between 3 and 5;
b. introducing ozone into the solution while controlling pH between 3 and 5 by addition of anhydrous ammonia and precipitating cerium oxide>90% from the solution; and
c. removing the precipitated cerium oxide from the solution.

In a third aspect, the present invention relates to a method for separating rare earth elements including the steps of:

a. slurrying a rare earth concentrate (e.g., rare earth carbonate or oxide) with water and mixing with an ammonium salt, such as nitrate, halide or sulfate;
b. treating the slurry with ozone to produce a high purity Ce concentrate (e.g., preferably >90% or >95%) and a solution including other solubilized rare earths;
c. removing cerium solid precipitates from the solution including the other solubilized rare earth elements, including La, Nd, Pr. etc.; and
d. treating the solution including the other solubilized rare earths with pH adjustments to sequentially produce separated rare earth concentrates capable of being processed into high purity rare earth elements.

DESCRIPTION OF THE PREFERRED EMBODIMENTS

Figure 1:
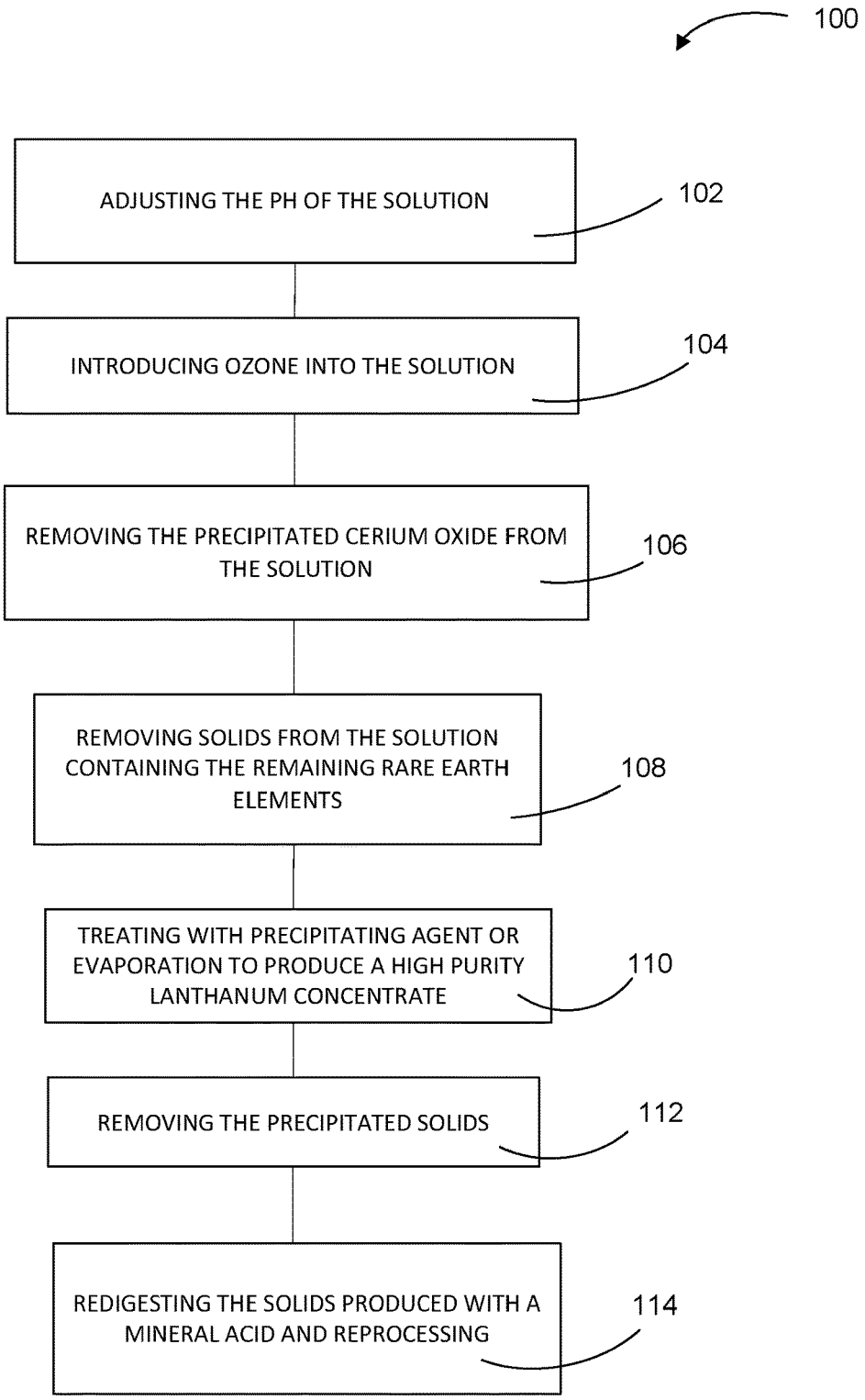
FIG. 1 shows a block diagram illustrating a first method in accordance with a first preferred embodiment of the present invention.

For the purposes of promoting an understanding of the principles of the present invention, reference will now be made to the embodiments illustrated in the drawings and specific language will be used to describe the same. It will nevertheless be understood that no limitation of the scope of the present invention is hereby intended and such alterations and further modifications in the illustrated devices are contemplated as would normally occur to one skilled in the art.

Where the specification describes advantages of an embodiment or limitations of other prior art, the applicant does not intend to disclaim or disavow any potential embodiments covered by the appended claims unless the applicant specifically states that it is "hereby disclaiming or disavowing" potential claim scope. Moreover, the terms "embodiments of the invention", "embodiments" or "invention" do not require that all embodiments of the invention include the discussed feature, advantage, or mode of operation, nor that it does not incorporate aspects of the prior art which are sub-optimal or disadvantageous.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Additionally, any examples or illustrations given herein are not to be regarded in any way as restrictions on, limits to, or express definitions of, any term or terms with which they are utilized. Instead, these examples or illustrations are to be regarded as illustrative only.

As used herein, the singular forms "a", "an" and "the" are intended to include the plural forms as well, unless the context clearly indicates otherwise. Additionally, the word "may" is used in a permissive sense (i.e., meaning "having the potential to"), rather than the mandatory sense (i.e., meaning "must"). Further, it should also be understood that throughout this disclosure, unless logically required to be otherwise, where a process or method is shown or described, the steps of the method may be performed in any order (i.e., repetitively, iteratively or simultaneously) and selected steps may be omitted. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Additionally, any examples or illustrations given herein are not to be regarded in any way as restrictions on, limits to, or express definitions of, any term or terms with which they are utilized. Instead, these examples or illustrations are to be regarded as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

To minimize the limitations found in the prior art, and to minimize other limitations that will be apparent upon the reading of the specification, preferred embodiments of the present invention may preferably provide methods for separating rare earth elements from rare earth leach solutions and carbonate concentrates.

Referring now to FIG. 1, according to a first preferred embodiment, process/methods of the present invention may start with a rare earth bearing leach solution. Typically, the source of such rare earth leach solutions may be acid digestion of rare earth bearing concentrates or ores. Preferably, the rare earth leach solution of the present invention may be formed of aqueous rare earth salts with the anion being nitrate ($NO_3^-$), halide ($F^-$, $Cl^-$, $Br^-$, $I^-$), or sulfate ($SO_4^-$). Preferably, the mineral acid of the present invention may be of any concentration and may preferably have a pH of less than 4. According to further preferred embodiments, the mineral acid may preferably have a pH of less than 1.

According to further preferred embodiments, the leach mixture may preferably include a leach solution which includes at least rare earth ions and a solid material. The leach solution may also include at least one metal ion. For example, the at least one metal ion may include at least one aluminum ion, at least one zinc ion, at least one copper ion, at least one nickel ion, at least one titanium ion and/or at least one iron ion. The leach solution may preferably be heated to improve the extraction of the rare earths from the rare earth bearing material.

The rare earth concentrate preferably is made up of about 0.1% REO up to 100% REO and is digested by a mineral acid which may preferably be nitric, hydrochloric, sulfuric or acetic acid. The final pH of the digestion is preferably less 4. According to further preferred embodiments, the final pH of the digestion may preferably be <2 or more preferably <1. At a first step 102, the pH of the solution may then preferably be adjusted. According to a preferred embodiment, the pH may be adjusted to range between 3-5 or between 3-6. According to further preferred embodiments, the adjusted pH of the solution may preferably be <5 or more preferably <3.

After the solution is within the target pH range, at a next step 104 ozone may be introduced while the pH is controlled to maintain a pH between 3-6. Preferably, the treatment of the solution precipitates high purity cerium oxide. According to a preferred embodiment, the high purity cerium oxide precipitated is preferably in the range of 90% purity or greater. According to further preferred embodiments, the purity is preferably greater than 95% and most preferably greater than 97%.

At a next step 106, treatment is continued until the cerium is removed from the solution as precipitated cerium. According to alternative preferred embodiments, the removal of the cerium may then be carried out by any means of solid liquid separation. According to preferred embodiments, the solution is then pH adjusted to between 6.0 and 7.0. At the desired pH, preferably greater than 6, medium/heavy rare earth along with Nd and Pr are precipitated.

According to further preferred embodiments, the treatment of the present invention is preferably continued until the desired quantity of target rare earths (e.g., mid/heavy rare earths and Nd and Pr) are removed from the solution as precipitant. At a next step 108, the precipitant/solids may then be removed from the solution by a desired solid-liquid separation method.

At a next step 110, the remaining solution is then preferably treated with a precipitating agent (i.e., carbon dioxide, hydroxide or oxalate) or evaporated to produce a high purity lanthanum concentrate. This may preferably produce a concentrate having a lanthanum purity greater than 95% and more preferably greater than 98%. According to a preferred next step 112, the solids containing La are then preferably removed from solution by a further solid-liquid separation technique.

According to preferred embodiments, at a next step 114, the solids produced in the above treatments may preferably be redigested by a mineral acid and reprocessed as outlined above to produce higher purity rare earth elements. For example, the produced La concentrate may be digested by a mineral acid and the resulting solution may then be further reprocessed/treated as per conditions disclosed with regards to the medium/heavy/neodymium-praseodymium stage to upgrade and purify the La further.

Figure 2:
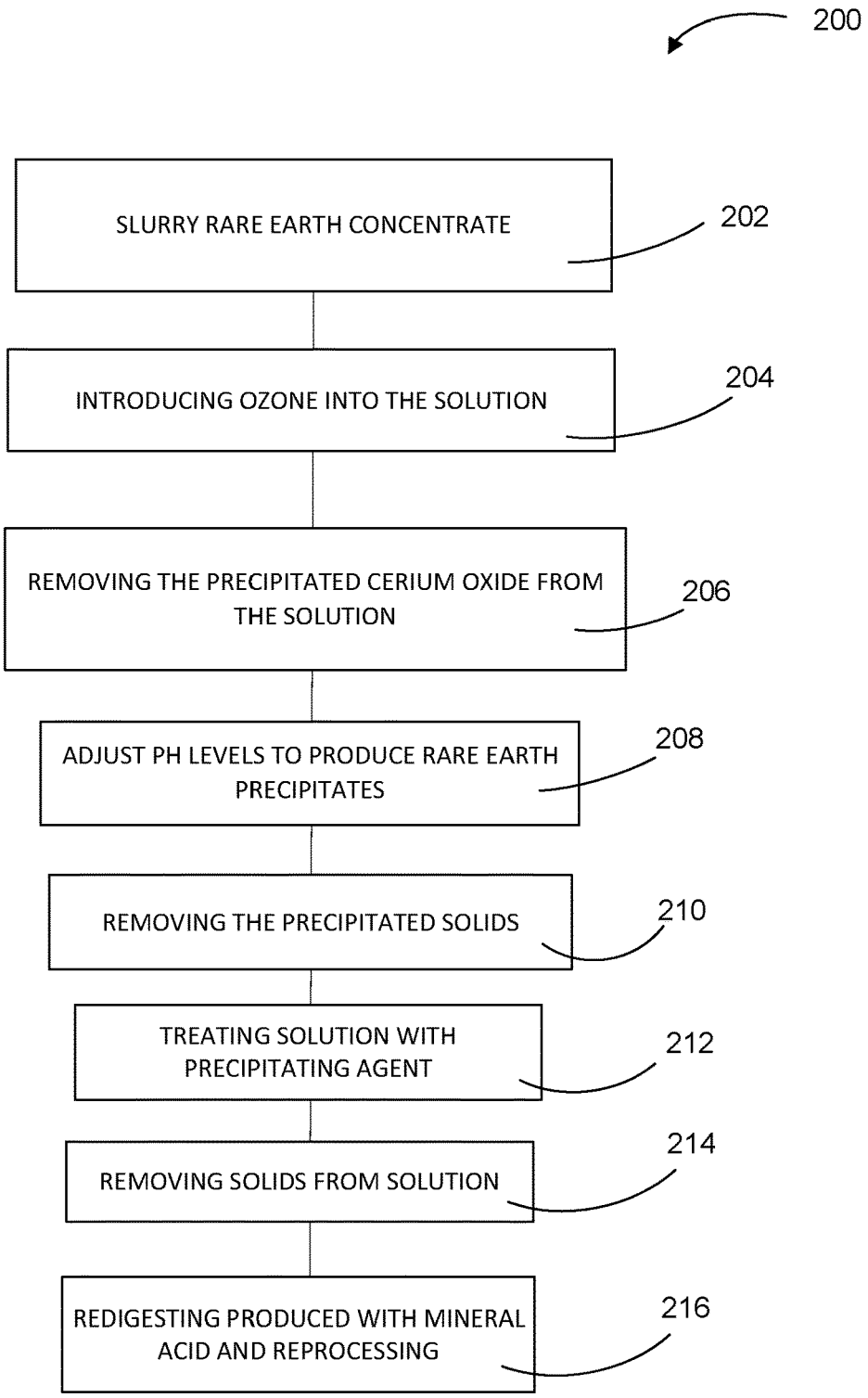
FIG. 2 shows a block diagram illustration a second method in accordance with an alternative preferred embodiment of the present invention.

With reference now to FIG. 2, a second embodiment shall now be discussed. At a first step 202, a rare earth concentrate (such as a rare earth carbonate) may preferably be slurried with water and mixed with ammonium bearing salts such as nitrate, halide or sulfate. The rare earth concentrate may be a mixture of two or more rare earth elements, one of which is Ce. According to preferred embodiments, in the first step 202 the slurry may be formed by mixing 1 part carbonate to 1 to 20 parts of water together with 0.5 to 4 parts of ammonium salts to 1 part of rare earth concentrate. At a next step 204, the slurry may then be treated with ozone to produce a high purity cerium concentrate while other rare earths are solubilized. At a next step 206, the cerium solids may then be removed by a solid-liquid separation technique. According to preferred embodiments, at a next step 208 the resulting solution may then preferably be treated in stages with a pH neutralizing technique (as described previously) to produce separated rare earth precipitates to be reprocessed into high purity rare earth elements. Preferably the solution is pH neutralized to between 6.0 and 8.0, and most preferably between 6.0 and 7.0.

Within the desired pH range, the medium/heavy rare earths (along with Nd and Pr) are preferably precipitated out while the pH is maintained to continue the precipitation. According to preferred embodiments, this treatment is continued until the desired quantity of Nd and Pr are depleted from the solution. Thereafter, at next step 210 the participant/solids are then preferably removed from the solution by a solid-liquid separation technique.

At a next step 212, the remaining solution is then treated with a precipitating agent (e.g., such as a base, carbonate or chelating agent) to produce a high purity lanthanum concentrate. This concentrate may contain greater than 95% lanthanum, and preferably greater than 98% lanthanum. At next step 214, the solids are then preferably removed from solution. At a next step 216, the produced solids may be redigested by a mineral acid and reprocessed as outlined above to produce higher purity rare earth elements.

The following examples are given by way of illustration and in no way should be construed as limiting the scope of the present invention.

Examples

A rare earth concentrate containing 50% Ce, 30% La and 19% Nd—Pr and 1% Sm—Lu in carbonate form is digested in hydrochloric acid to produce a rare earth chloride solution at a final pH of 1. The solution is pH adjusted to a pH of 3 and ozone is introduced. The pH may then be kept between 2.5 and 6 until the desired amount of Ce is removed from the solution at the desired purity (preferably 95-98%). Solids including cerium are then preferably removed from the solution. The remaining dissolved rare earths may preferably be further processed by adjusting the pH to a value between 6-8 to precipitate the medium/heavy rare earth preferentially with NdPr. This medium/heavy/Nd—Pr concentrate may preferably be removed from the solution by solid liquid separation. According to a preferred embodiment, the remaining leach solution preferably should contain only high purity La (preferably >97%). This material may then be further precipitated to produce a high purity La compound.

Subsequently, if desired purity of Nd—Pr, La or Ce is not achieved, the purified material may then be digested by hydrochloric acid and pH treatment may then be repeated as described above to target specific impurity elements. Purities as high as 99.9% can be achieved through this methodology.

While the above descriptions regarding the present invention contain much specificity, these should not be construed as limitations on the scope, but rather as examples. Many other variations are possible. Accordingly, the scope of the present invention should be determined not by the embodiments illustrated, but by the appended claims and their legal equivalents.

What is claimed is:

1. A method for separating rare earth elements comprising the steps of:

a. treating a leach solution; wherein the leach solution comprises at least two rare earth metal salts; wherein the leach solution is treated with a neutralizing process to achieve a pH of between 2 and 6;

b. introducing ozone into the solution while controlling pH between 2 and 6 and precipitating cerium oxide from the solution;

c. removing the precipitated cerium oxide from the solution;

d. removing solids from the solution containing the remaining rare earth elements;

e. adjusting the pH of the solution to between 6.0 and 8.0 to precipitate medium/heavy rare earth along with Nd and Pr hydroxides;

f. removing the precipitated Nd—Pr and medium/heavy rare earths from the solution;

g. treating the remaining solution with a precipitating agent or evaporating to produce a lanthanum concentrate having a lanthanum purity of at least 95% by weight; and h. removing one or more precipitated solids from the solution.

2. The method of claim 1, further comprising: redigesting the solids produced in step (h) with a mineral acid and reprocessing following steps (a)-(h).

3. The method of claim 1, wherein the rare earth leach solution comprises aqueous rare earth salts.

4. The method of claim 3, wherein the aqueous rare earth salts are nitrate ($NO_3^-$), halide, or sulfate ($SO_4^{2-}$) salts.

5. The method of claim 1, further comprising the step of: digesting a rare earth bearing material with at least one mineral acid to form the leach solution of step (a).

6. The method of claim 5, wherein the at least one mineral acid has a pH of less than 1.

7. The method of claim 1, wherein the rare earth leach solution of step (a) further comprises a solid material.

8. The method of claim 1, wherein the rare earth leach solution of step (a) further comprises at least one non-rare earth metal ion.

9. The method of claim 8, wherein the non-rare earth metal ion comprises a non-rare earth metal ion selected from the group of non-rare earth metal ions comprising: aluminum, zinc, copper, nickel, titanium and iron.

10. The method of claim 5, further comprising the step of: heating the leach solution to improve extraction of the rare earths from the rare earth bearing material.

11. The method of claim 1, wherein the cerium oxide is of a purity greater than 90%.

* * * * *